US012201221B2

(12) United States Patent
Adjesson

(10) Patent No.: US 12,201,221 B2
(45) Date of Patent: Jan. 21, 2025

(54) BEDDING SYSTEM FACILITATING COMFORTER STAYING TUCKED AND PROVIDING FOR EFFICIENT MAKING OF BED

(71) Applicant: Eric Adjesson, Stone Mountain, GA (US)

(72) Inventor: Eric Adjesson, Stone Mountain, GA (US)

( * ) Notice: Subject to any disclaimer, the term of this patent is extended or adjusted under 35 U.S.C. 154(b) by 391 days.

(21) Appl. No.: 17/574,328

(22) Filed: Jan. 12, 2022

(65) Prior Publication Data

US 2022/0133052 A1 May 5, 2022

Related U.S. Application Data

(63) Continuation-in-part of application No. 29/728,952, filed on Mar. 23, 2020, now Pat. No. Des. 979,290, (Continued)

(51) Int. Cl.
*A47C 21/02* (2006.01)
*A47G 9/02* (2006.01)
*A45F 3/04* (2006.01)

(52) U.S. Cl.
CPC ..... *A47C 21/022* (2013.01); *A47G 9/0238* (2013.01); *A45F 3/047* (2013.01); (Continued)

(58) Field of Classification Search
CPC ..... A45F 3/047; A47C 21/02; A47C 21/022; A47C 21/028; A47G 9/0207; A47G 9/0223; A41C 3/0028
See application file for complete search history.

(56) References Cited

U.S. PATENT DOCUMENTS 1,910,891 A * 5/1933 Freysinger ..... A41F 1/008 24/593.11
2,497,186 A * 2/1950 Pedersen ..... A47C 21/022 5/494

(Continued)

FOREIGN PATENT DOCUMENTS

WO WO1992007495 A1 5/1992

OTHER PUBLICATIONS

How To Properly Tie A Waistcoat, MrWaheedulHaque, Dec. 30, 2018, Entire Video, https://www.youtube.com/watch?v=aOaJPnGf3MY.*

*Primary Examiner* — Justin C Mikowski
*Assistant Examiner* — Morgan J McClure

(57) ABSTRACT

A bedding system comprises an anchor assembly and a comforter to provide optimal sleep experience and minimize the effort of making of a bed for sleep. The anchor assembly is formed to "box" in a mattress with the comforter installed on the front face of the mattress. Various types of adjustable anchors are attached to an anchor band of the anchor assembly and connect to the comforter along two longitudinal sides and a bottom side of the mattress so that the comforter can stay tucked on the mattress at all times. The anchors allow a user to make adjustments of tightness of the comforter to achieve ultimate comfort and high-quality sleep while the user is tucked in during sleep. The bedding system provides efficient connections between the anchors and the comforter, and/or a fitted sheet, thus facilitating easy disconnection of the system for washing and/or replacement.

18 Claims, 16 Drawing Sheets

Related U.S. Application Data and a continuation-in-part of application No. 16/810,359, filed on Mar. 5, 2020, now abandoned.

(52) U.S. Cl.
CPC ..... *A47C 21/02* (2013.01); *A47C 21/028* (2013.01); *A47G 9/0207* (2013.01)

(56) References Cited

U.S. PATENT DOCUMENTS 2,789,292 A * 4/1957 Budinquest ..... A47G 9/02 5/494
2,832,967 A * 5/1958 Sobel ..... A47G 9/0207 2/69.5
2,930,053 A * 3/1960 Nowels ..... A47C 21/022 5/498
3,179,958 A * 4/1965 Carris ..... A47G 9/0238 5/692
3,857,124 A * 12/1974 Hadley ..... A47G 9/02 5/494
4,301,561 A * 11/1981 McLeod ..... A47G 9/02 5/923
4,488,323 A * 12/1984 Colburn ..... A47G 9/0238 5/923
4,646,375 A * 3/1987 Parker ..... A47G 9/0246 5/923
4,653,131 A * 3/1987 Diehl ..... A47C 21/08 5/494
4,742,821 A * 5/1988 Wootan ..... A61F 5/3776 5/494
4,853,996 A * 8/1989 Harrigan ..... A61F 5/3776 5/494
4,976,017 A * 12/1990 Frano ..... A44B 11/20 24/DIG. 43
5,027,456 A * 7/1991 Wadsworth ..... A61F 5/3776 5/494
5,099,531 A * 3/1992 Schmier ..... A47C 21/022 5/494
5,101,527 A * 4/1992 Wadsworth, III ..... A47C 27/15 5/699
5,367,729 A * 11/1994 Lazar ..... A47G 9/02 5/692
5,608,951 A * 3/1997 Chou ..... B60P 7/0823 24/302
5,687,455 A * 11/1997 Alexander ..... B65D 63/1072 24/593.11
5,794,285 A * 8/1998 Burch ..... A47G 9/02 5/500
6,044,503 A * 4/2000 McClendon ..... A47G 9/02 5/493
6,098,219 A * 8/2000 Milber ..... A47C 21/022 5/494
6,233,764 B1 * 5/2001 Orr ..... A47G 9/0246 5/692
6,343,384 B1 * 2/2002 Ida ..... A41F 1/008 2/338
6,438,805 B1 * 8/2002 Goss ..... A47C 21/026 24/301
6,739,002 B1 * 5/2004 Pannu ..... A47G 9/04 5/923
6,851,902 B2 * 2/2005 Stanley ..... B60P 7/0823 410/97
7,007,325 B1 * 3/2006 Gomeh ..... A47G 9/02 5/923
7,669,257 B2 * 3/2010 Swihart ..... A47G 9/02 5/502
7,827,633 B2 * 11/2010 Taylor ..... A47C 21/022 5/500
8,272,821 B2 * 9/2012 Digman ..... B60P 7/0823 410/115
8,332,976 B1 * 12/2012 Goldwater ..... A47G 9/02 5/484
8,444,101 B2 * 5/2013 Holman ..... B65D 75/56 24/68 CD
8,898,834 B1 * 12/2014 Huber ..... A47C 31/105 5/482
9,907,419 B1 * 3/2018 Mun ..... A47G 9/0246
10,104,981 B2 * 10/2018 Nekhala ..... A47G 9/0246
10,159,291 B1 * 12/2018 Ortega ..... A43C 11/12
10,405,671 B2 * 9/2019 Emile ..... A47C 21/028
10,610,034 B2 * 4/2020 Sturgeon ..... A47G 9/0292
10,813,416 B2 * 10/2020 Liu ..... A44B 11/2592
10,932,585 B1 * 3/2021 Sopher ..... A47C 21/028
2003/0019037 A1 * 1/2003 Michaelis ..... A47G 9/02 5/497
2004/0060113 A1 * 4/2004 Lantagne ..... A47C 21/022 128/869
2006/0174459 A1 * 8/2006 Bledsoe ..... A41F 1/008 24/634
2009/0172881 A1 * 7/2009 Peterson ..... A47C 21/022 5/497
2009/0241261 A1 * 10/2009 Sack ..... A47C 21/022 5/498
2009/0265855 A1 * 10/2009 Hawk ..... A47D 15/001 5/655
2011/0173750 A1 * 7/2011 Lehmann ..... A47G 9/0238 5/486
2012/0174355 A1 * 7/2012 Fraze ..... A43C 11/1486 24/68 A
2012/0186013 A1 * 7/2012 Ponsi ..... A61G 7/001 5/81.1 R
2013/0152306 A1 * 6/2013 Monaco ..... A47G 9/0261 5/498
2013/0283528 A1 * 10/2013 Tzur ..... A47C 21/022 5/498
2015/0289600 A1 * 10/2015 Shirai ..... A41F 1/008 24/191
2015/0327685 A1 * 11/2015 Longnecker ..... A47C 21/022 5/498
2016/0022053 A1 * 1/2016 Martin ..... A47C 21/028 5/703
2016/0309853 A1 * 10/2016 Snyder ..... A44B 11/12
2017/0202361 A1 * 7/2017 White ..... A47C 21/022
2018/0184819 A1 * 7/2018 Gaudyn ..... A47G 9/04
2018/0192780 A1 * 7/2018 Lowe ..... A47C 21/022
2018/0263322 A1 * 9/2018 Martin ..... A41D 1/06
2018/0263386 A1 * 9/2018 Janney ..... A47G 9/0207
2019/0053581 A1 * 2/2019 Hestvik ..... A41F 9/025
2020/0268067 A1 * 8/2020 Curtiss ..... A41D 11/00
2020/0390252 A1 * 12/2020 Lee ..... A47G 9/0207
2021/0002096 A1 * 1/2021 Wang ..... A41F 1/008
2021/0015216 A1 * 1/2021 Kim ..... A41F 9/025

* cited by examiner

BEDDING SYSTEM FACILITATING COMFORTER STAYING TUCKED AND PROVIDING FOR EFFICIENT MAKING OF BED

FIELD OF THE INVENTION

The present invention relates generally to bedding. More specifically, the present invention relates to a bedding system that keeps a comforter staying tucked at all times and provides efficient making of a bed always ready for a next use. The bedding system of the present invention offers a user ultimate comfort for sleep with adjustable tightness of a fitted sheet, if used, and the comforter being tucked on the bed through a unique and innovative anchor assembly that incorporates various anchors of optimal performance of the bedding system. Additionally, the bedding system provides significantly more easiness and effectiveness of making the bed with minimum time and effort thereof comparing with conventional bedding systems.

BACKGROUND OF THE INVENTION

Nowadays, normal beds are usually made with a fitted sheet and a top sheet tucked under a mattress supported by a box spring, a metal frame, or the like. A comforter or duvet with a duvet cover is loosely placed on top of the top sheet. During normal use, the bed covering, either being loosely laid on the bed or tucked under the mattress along with the top sheet, can get pulled free from the bed or kicked out of the desired layout of a user when sleeping, thus causing the bed to be completely re-made after each use by the user. Making the bed takes extra time and effort for the user and may include tidying sheets and the comforter, tucking the bed covering back under the mattress again, etc. This may be frustrating especially if the user has a very busy schedule and/or a busy lifestyle every day. Additionally, this can frustrate and irritate the user who may become uncovered, cold, and uncomfortable since the bed coverings may get mangled and/or even kicked out of the bed.

Most existing bedding systems and methods trying to solve the problems of bed-making and disorderly bedding are either complicated or ineffective. Many systems include apparatuses or devices to bed coverings or mattresses trying to keep bed coverings staying in the original position during use. The user must attach these systems to a purchased the bed covering or bed and/or mattress. Such an attachment not only requires alteration of bedding covers and/or beds, but also may cause damages to the bedding systems during attachment processes. Many other systems, however, try to eliminate tucking of any bedding covers to the bed, which may not be desired by many users who enjoy sleeping while being tucked in. Some recent improvements focused on the removable attachment of bedding layers and/or fasteners such as straps, clamps, fabric tie-downs to be used over the bedding coverings and/or mattresses. These systems, however, may cause uncomfortable experience to the user during sleep. Since these systems do not have a mechanism for the user to adjust the attachment to achieve desired comfort when sleeping in, the user may end up eliminating altogether.

It is an objective of the present invention to provide an optimal solution to the aforementioned problems for bedding system. The present invention comprises a bedding system that features an innovative anchor assembly and a comforter. The anchor assembly fits to a back face and all four sides of a mattress, with or without a fitted sheet, and an anchor band of the anchor assembly is configured to be wrapped around the four sides of the mattress, thus keeping the comforter staying tucked all the time. Further, the anchor assembly includes adjustable anchors, the bedding system not only keeps the comforter in position when the user sleeps in bed, but also allows the user to make adjustments to the tightness of the comforter being tucked on the bed. Therefore, the bedding system can eliminate or minimize the effort of bed making after each use and enable the user to achieve ultimate comfort during sleep.

SUMMARY OF THE INVENTION

The present invention is a bedding system that comprises an anchor assembly, an optional fitted sheet, and a comforter. The anchor assembly includes a base and an anchor band that are attached together to form an assembly resembling an open box such that a mattress chosen by a user can fit into the anchor assembly with the top face of the mattress exposed, covered with or without the fitted sheet. The anchor band includes band fasteners that connect both ends thereof so that the anchor band tightly wraps around all four side of the mattress of a bed. Various anchors are attached to the anchor band and are attached to the sides and the foot portion of the comforter. Optionally, the anchors may be connected to the fitted sheet. Thus, the bedding system can keep the comforter staying tucked all the time and provides efficient making of a bed. The anchors of the anchor assembly each include adjustable mechanisms to allow the user to make adjustments of tightness of the comforter and optionally the tightness of the fitted sheet, if necessary, thus achieving an ultimate comfort and high-quality sleep. The constant, desired pressure exerted on the comforter by the anchors keeps the comforter staying tucked and in position during the user's sleep, thus minimizing and/or eliminating the need/effort of bed-making after each use of the present invention. The anchor assembly and comforter system can be conveniently and effectively installed by the user. The parts of the present invention are also removably connected, which allows the user to easily disconnect for washing and replacement of any components. The anchor assembly can be made to various sizes to fit to various types of beds such as king, queen, full sizes, etc. Further, the comforter comprises extenders on each of the longitudinal sides and the foot portion, which offers the flexibility for the present invention to fit to various thicknesses of mattresses and beds.

The comforter comprises a flap that can be folded to the front top surface of the comforter, which allows the user easy access to the bed for a comfortable sleep. After sleep, the user can easily flip the flap to achieve the neat appearance of the bed with the comforter being tucked in place. Further, the comforter of the bedding system may comprise a skirt that flares out on both the longitudinal sides and the foot area of the bed to offer a high bed and/or traditional display of the bed.

DETAIL DESCRIPTIONS OF THE INVENTION

All illustrations of the drawings are for the purpose of describing selected versions of the present invention and are not intended to limit the scope of the present invention.

As can be seen in FIG. 1 to FIG. 16, the present invention comprises a bedding system that keeps a comforter staying tucked at all times and provides efficient making of a bed. The bedding system of the present invention offers a user ultimate comfort for sleep with active adjustable tightness of the comforter being tucked on the bed, wherein an anchor assembly provides continuous adjustments with the movements of the user during sleep. The anchor assembly includes a base and an anchor band that are formed into a "box" to fit a mattress, wherein the mattress "sits" in this open top box with a front face of the mattress exposed and all four sides being wrapped around by the anchor band. Additionally, the anchor assembly comprises anchors, wherein the anchors are attached to the exterior surface of the anchor band. The anchors on the anchor band are detachably and adjustably attached to a bottom and two sides of the comforter when the comforter is placed on the mattress and hung over the mattress. Further, the anchors of the anchor assembly may be detachably and adjustably attached to a fitted sheet, wherein the fitted sheet is placed directly on the mattress with the comforter being assembled over the fitted sheet. Thus, through the anchor assembly of the present invention, the bedding system provides significantly more easiness and effectiveness of making the bed with a minimum of time and effort by a user comparing with conventional bedding systems.

Figure 1:
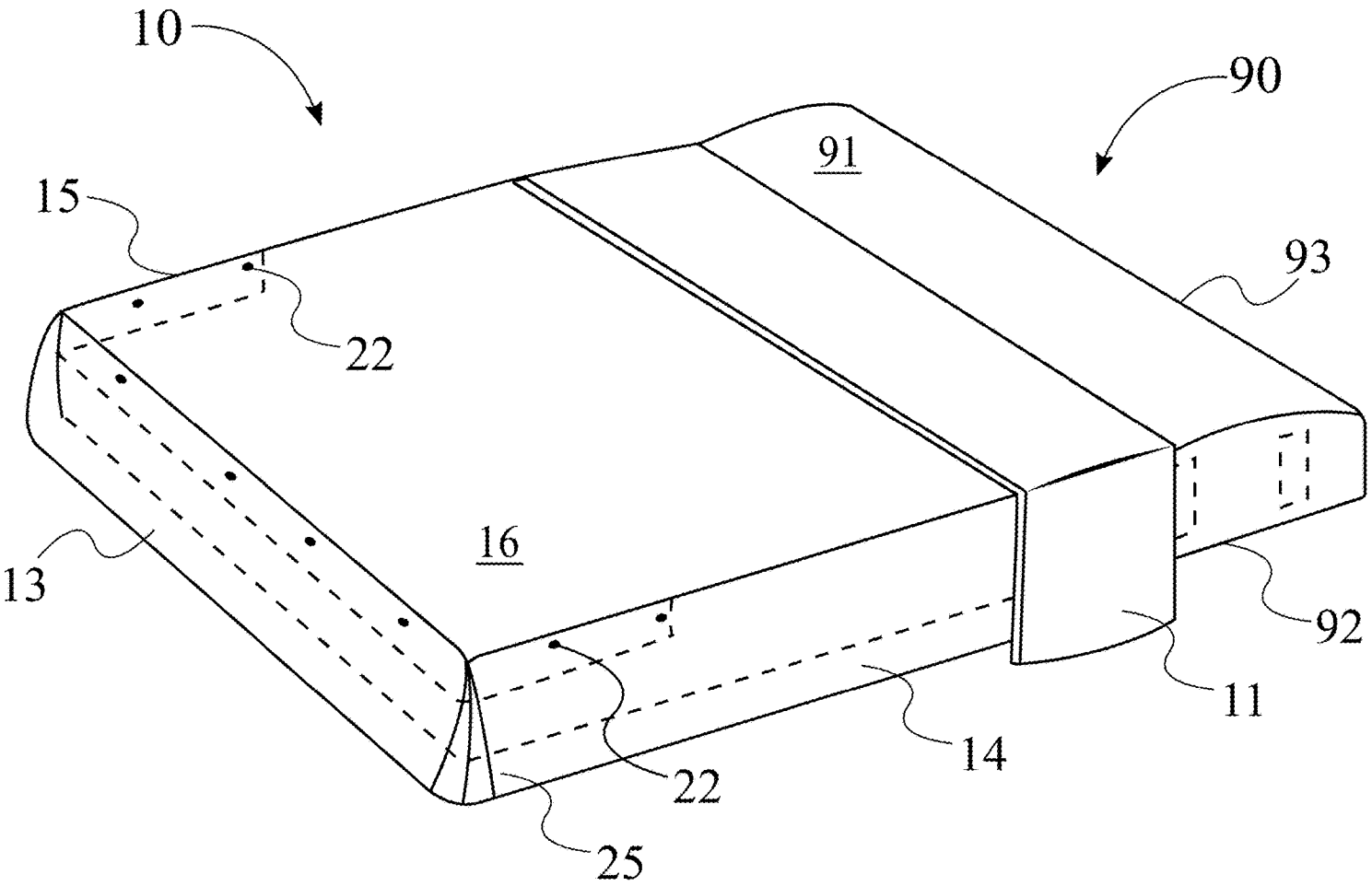
FIG. 1 is an isometric perspective view of the present invention, wherein a head flap of a classic comforter set is folded on a mattress.
Figure 2:
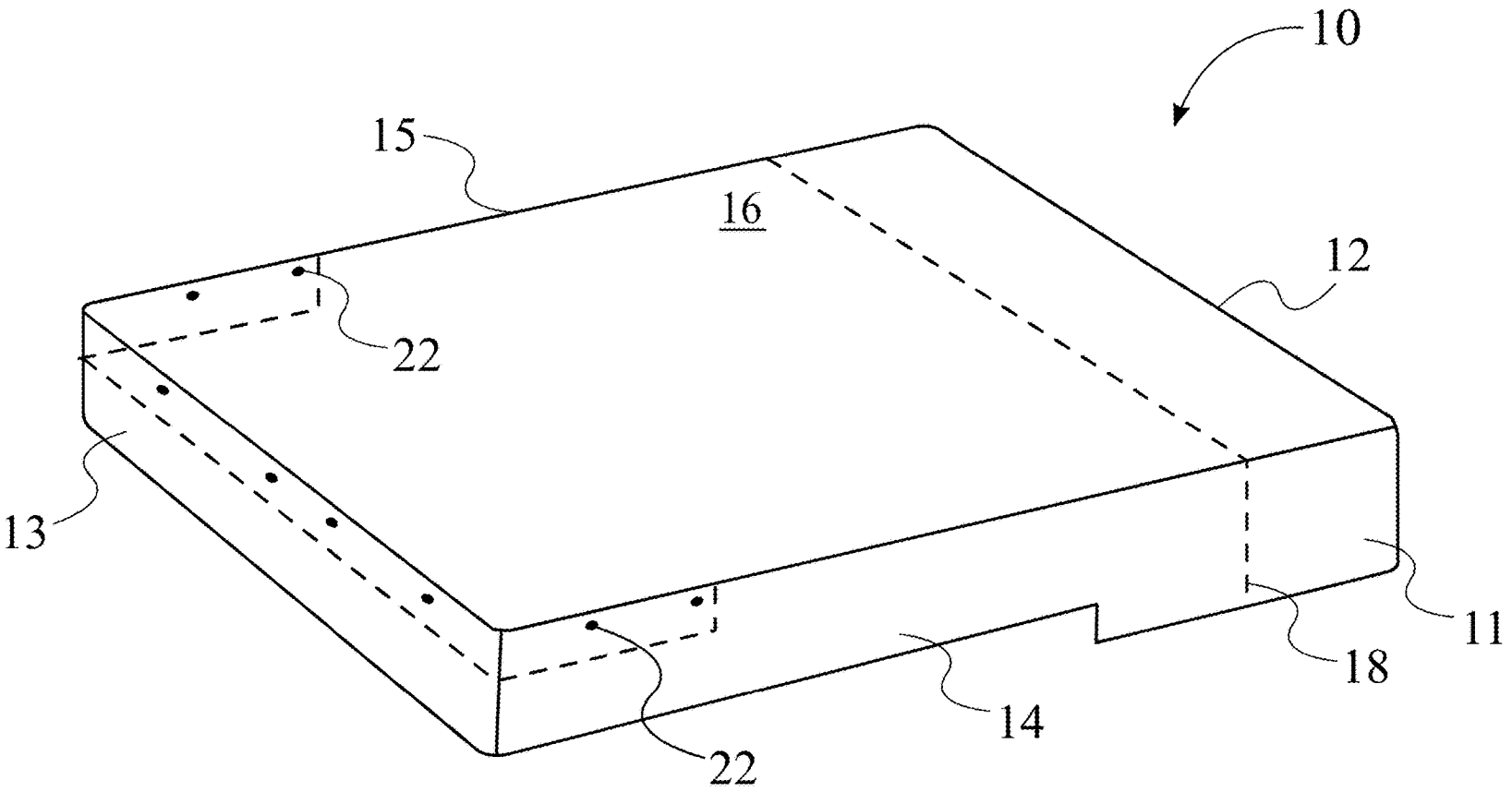
FIG. 2 is an isometric perspective view of the present invention, wherein a modern comforter set is placed on a top and all four sides of a mattress.
Figure 3:
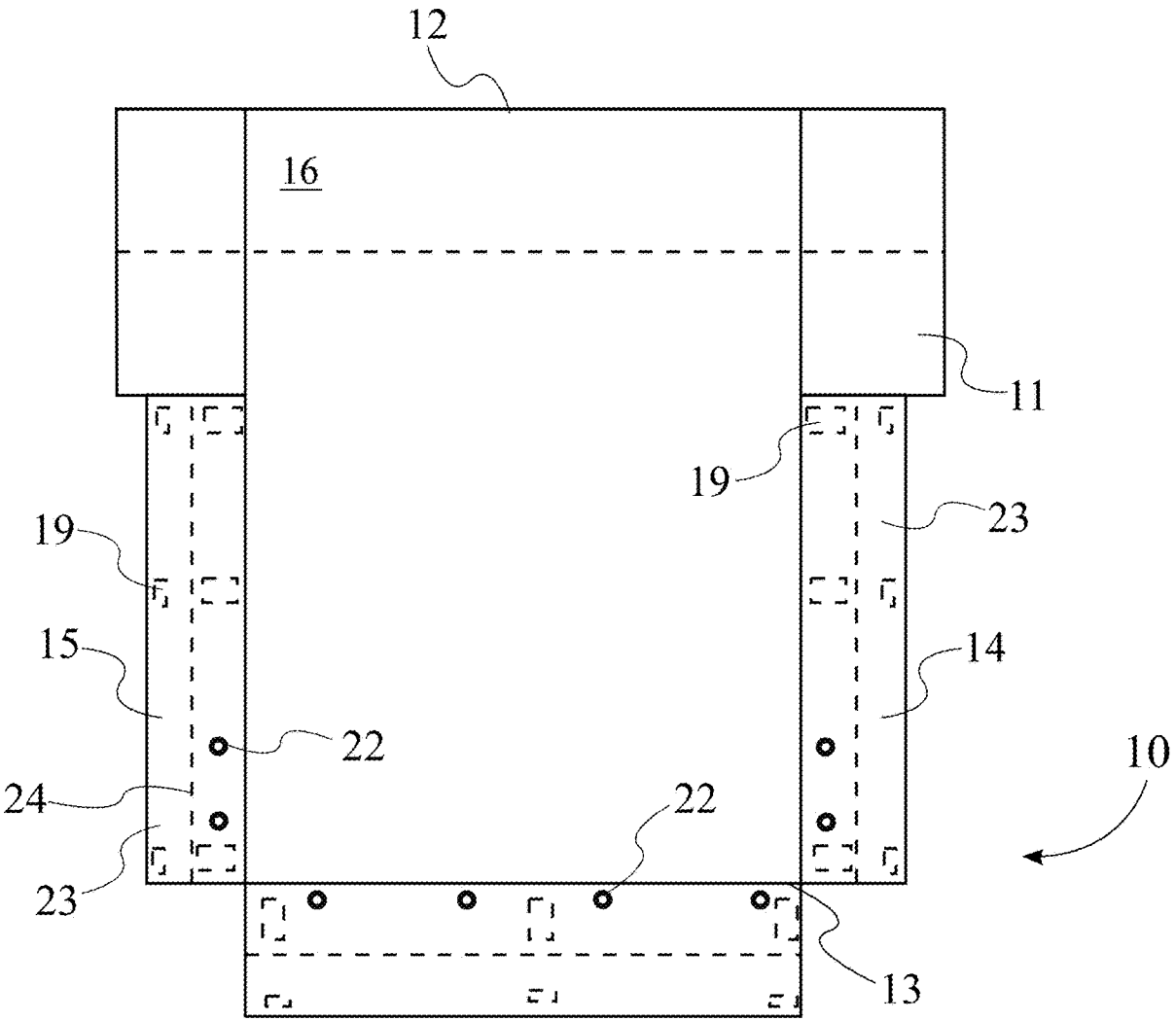
FIG. 3 is an exploded perspective view of a bedding system of the present invention.
Figure 4:
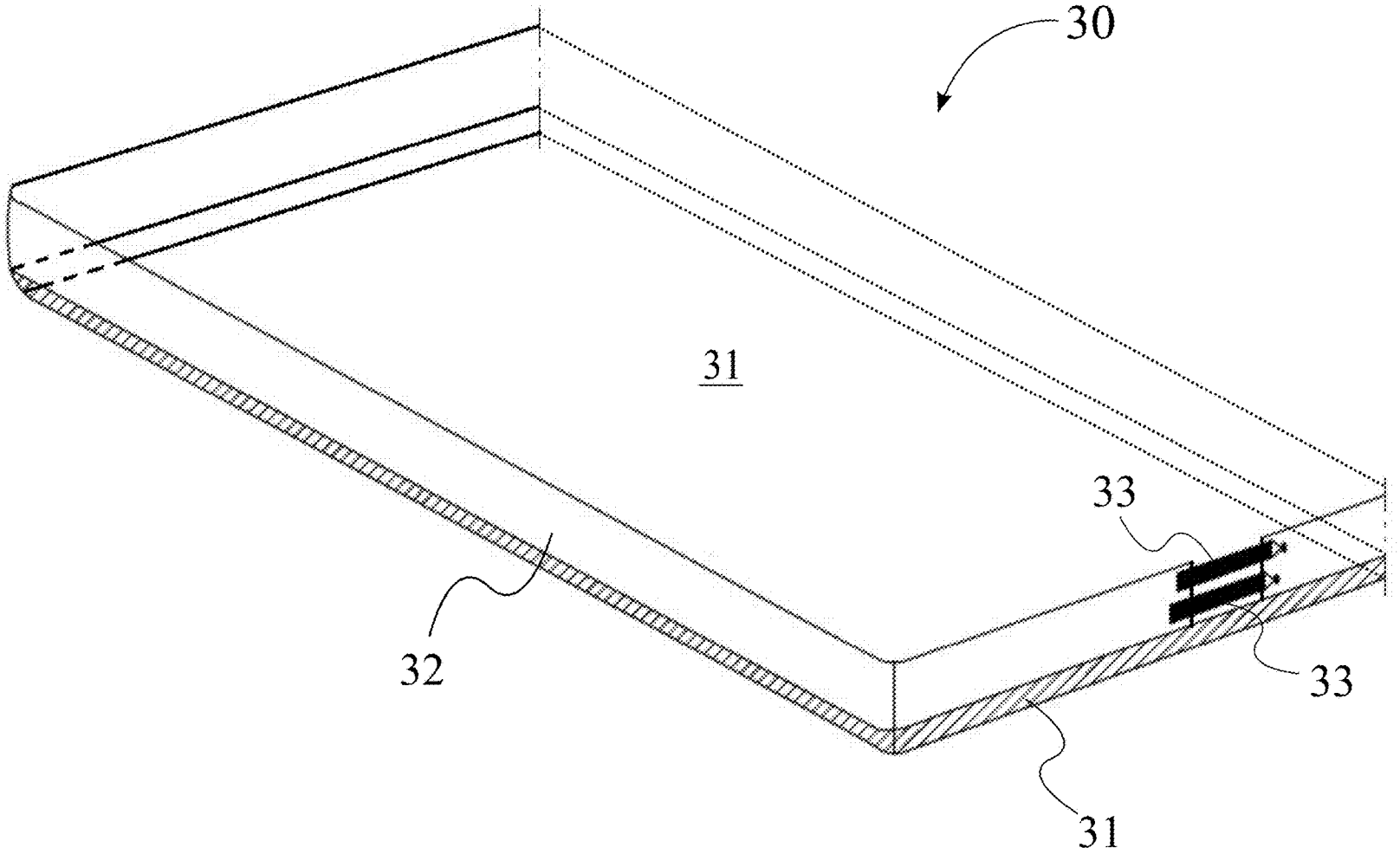
FIG. 4 is a perspective view of an anchor assembly of the bedding system of the present invention, wherein the anchor assembly is formed like a box to fit a mattress inside an anchor band.

As can be seen in FIG. 1 to FIG. 4, the bedding system of the present invention comprises a comforter 10, an anchor assembly 30, and a mattress 90. The mattress 90 comprises a front face 91 and back face 92. The comforter 10 comprises a top 12, a bottom 13, a first side 14, and a second side 15. The bottom 13, the first side 14, and the second side 15 of the comforter 10 are configured to be wrapped around the mattress 90 with the back face 92 exposed. The back face 92 of the mattress 90 normally is supported by a flat surface including, but not limited to, floor, ground, box spring, platform, etc. In the present invention, however, the back face 92 "sits" inside the anchor assembly 30, thus the anchor assembly 30 is wrapped around the entire back face 92 and all four sides of the mattress 90 as can be seen in FIG. 4. The anchor assembly 30 can fit to any specific mattress, including, but not limited to king bed, queen bed, full bed, etc. The front face 91 of the mattress 90 and all four sides except the head/top side surface of the mattress 90 against a headboard of a bed are wrapped around by the comforter 10, as can be seen in FIG. 1 and FIG. 2.

Figure 7:
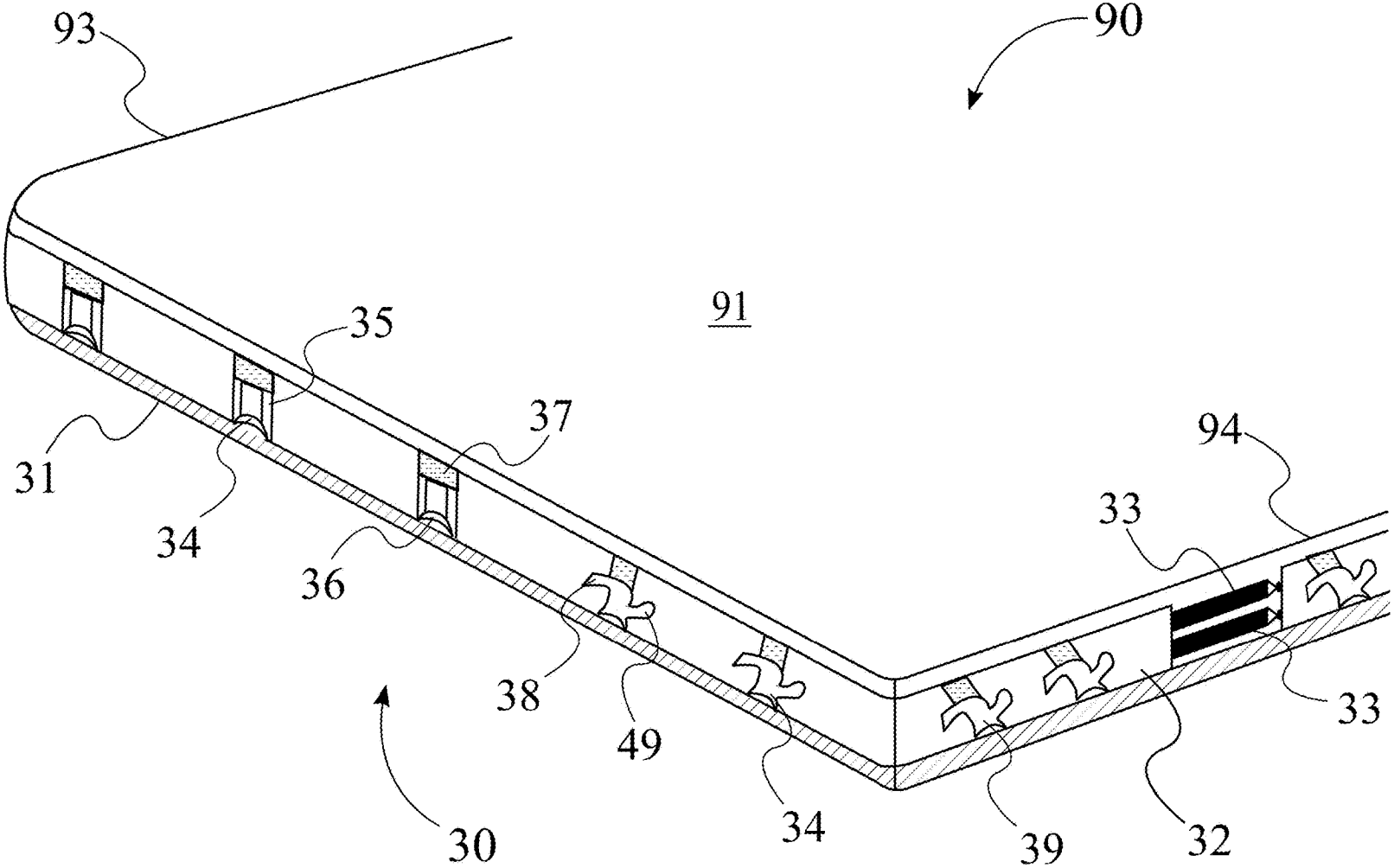
FIG. 7 is a perspective view of the anchor assembly of the bedding system of the present invention, wherein a plurality of anchors is attached to the anchor band that is wrapped around the sides of the mattress.

As can be seen in FIG. 4 and FIG. 7, the anchor assembly 30 is configured to be wrapped around all four sides and the back face 92 of the mattress 90. The anchor assembly 30 comprises a base 31, an anchor band 32, at least one band fastener 33, and a plurality of anchors 34. One end of the at least one band fastener 33 is terminally attached to one distal end of the anchor band 32 and the other end of the at least one band fastener 33 is terminally attached to the opposite end of the anchor band 32. The anchor band 32 is terminally and longitudinally attached to the perimeter of the base 31. The anchor band 32 and the base 31 are configured to form an open box to fit to the exterior of the mattress 90 with the front face 91 of the mattress 90 exposed. The plurality of anchors 34 is attached to the anchor band 32 and is removably and adjustably fastened to the comforter 10. At least one of the plurality of anchors 34 is fastened to the first side 14 between the center of the first side 14 and the bottom 13 of the comforter 10. Additionally, at least one of the plurality of anchors 34 is fastened to the second side 15 between the center of the second side 15 and the bottom 13 of the comforter 10. Further, at least one of the plurality of anchors 34 is fastened to the bottom 13 of the comforter 10. The plurality of anchors 34 of the anchor assembly 30 provides proper force to keep the comforter 10 tucked on the bed and the user comfortably tucked in the bed during sleep. Additionally, the plurality of anchors 34 allows the user easily to get up while still keeping the comforter 10 tucked on the bed thus eliminating lengthy bed-making process.

As can be seen in FIG. 3, the comforter 10 comprises a flap 11, the top 12, the bottom 13, the first side 14, the second side 15, a front 16, a back 17, a flap crease 18, a plurality of anchor fasteners 22, a plurality of extenders 23. Each of the plurality of extenders 23 further comprises an extender crease 24. Specifically, the flap 11 is positioned on the top 12 of the comforter 10 and folded to the front 16 of the comforter 10 at the flap crease 18. A pillow attachment may be attached to the front 16 of the comforter 10 adjacent the top 12. The pillow attachment can take various shapes and sizes that the user desires and may occupy the area between the edge of the top 12 and the flap crease 18. Each of the plurality of extenders 23 is attached to the bottom 13, the first side 14, and the second side 15 of the comforter 10. Additionally, each of the plurality of extenders 23 is attached to the comforter 10 at the extender crease 24, wherein the comforter 10 can fit to various thicknesses of the mattress with or without a support including, but not limited to, a spring box or any other suitable support, by folding or unfolding the plurality of extenders 23. Further, the comforter 10 may include, but is not limited to, a conventional comforter, a duvet with or without a duvet cover, a blanket, etc.

Figure 5:
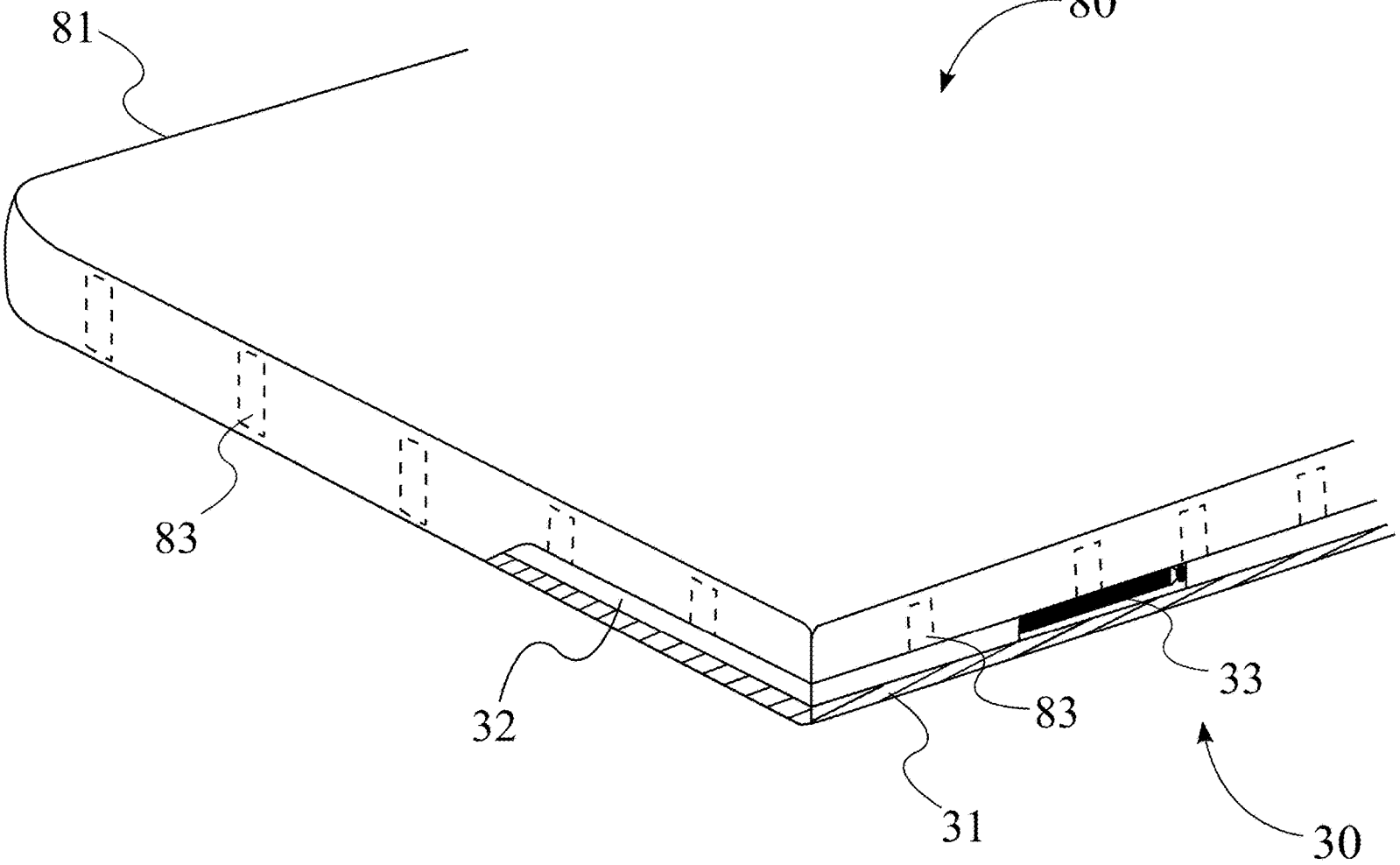
FIG. 5 is a perspective view of a fitted sheet of the bedding system of the present invention, wherein the fitted sheet covers the top and sides of the mattrass and a partial anchor assembly is wrapped around the exterior sides of the fitted sheet.
Figure 6:
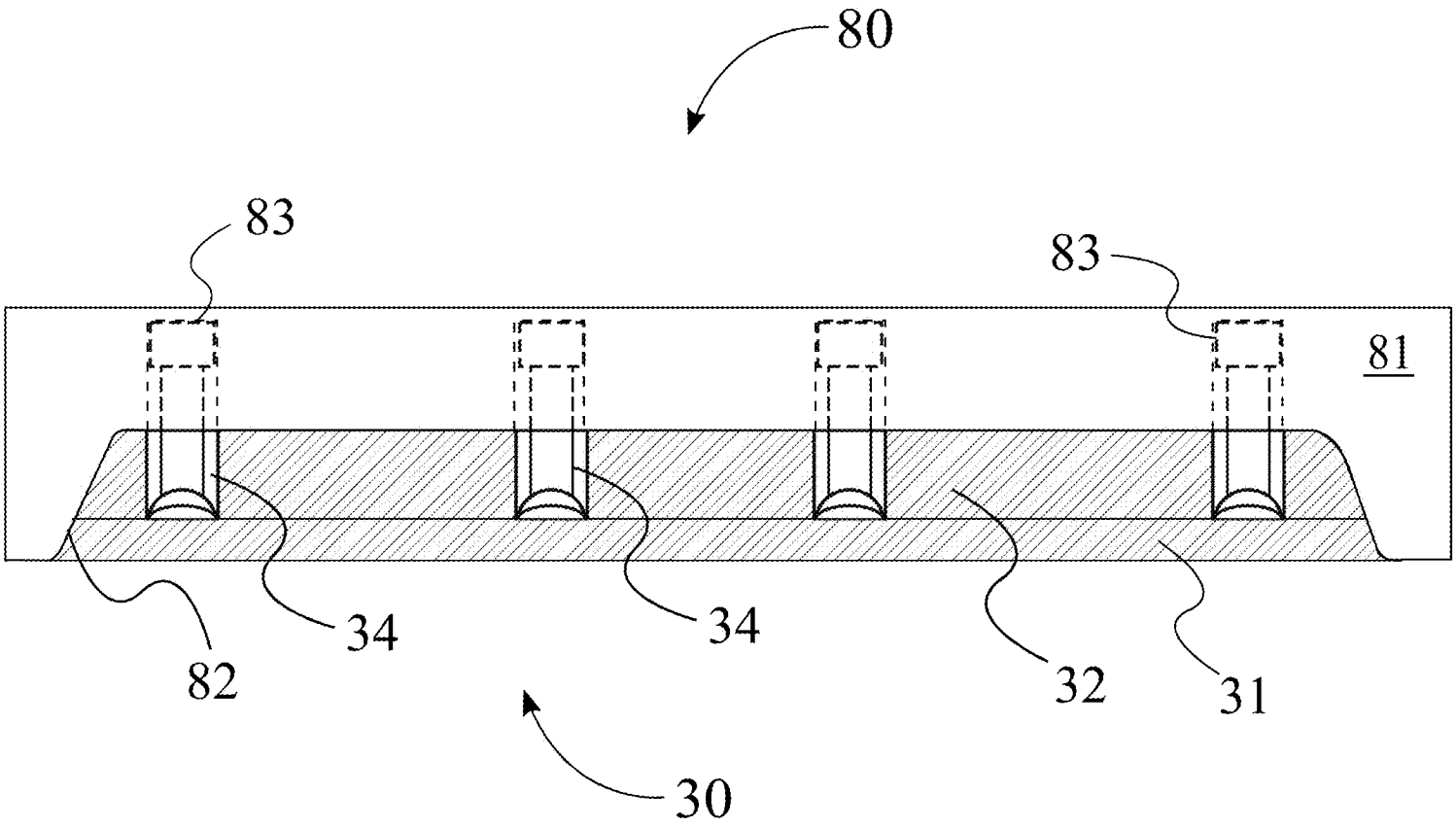
FIG. 6 is a front view of a head edge of the fitted sheet of the bedding system of the present invention, wherein the fitted sheet comprises a cutoff section to expose a head area of the mattress.

As can be seen in FIG. 5 to FIG. 6, the bedding system of the present invention comprises a fitted sheet 80. Specifically, the fitted sheet 80 is placed on the mattress 90 and positioned between the mattress 90 and the comforter 10 with the back face 92 of the mattress 90 exposed. The back face 92 of the mattress 90 is in direct contact with the base 31 of the anchor assembly 30. Additionally, the fitted sheet 80 is configured to be wrapped around the front face 91 and all four sides including the head 93 and the bottom 94. At least one of the plurality of anchors 34 of the anchor assembly 30 is removably and adjustably fastened to the fitted sheet 80 at each of the four sides of the mattress 90, thus stabilizing the fitted sheet 80 of the bedding system tightly on the mattress 90 at all times. Further, the fitted sheet 80 comprises a head edge 81, a head cutoff 82, and a plurality of edge fasteners 83, as can be seen in FIG. 6. The head cutoff 82 is terminally positioned on the head edge 81 and exposes an area of the head 93 of the mattress 90 from the center of the head 93 to the bottom 94 of the mattress 90, thus allowing the user to conveniently adjust the tightness of the fitted sheet 80 on the mattress 90 through the plurality of anchors 34 of the anchor assembly 30.

Figure 9:
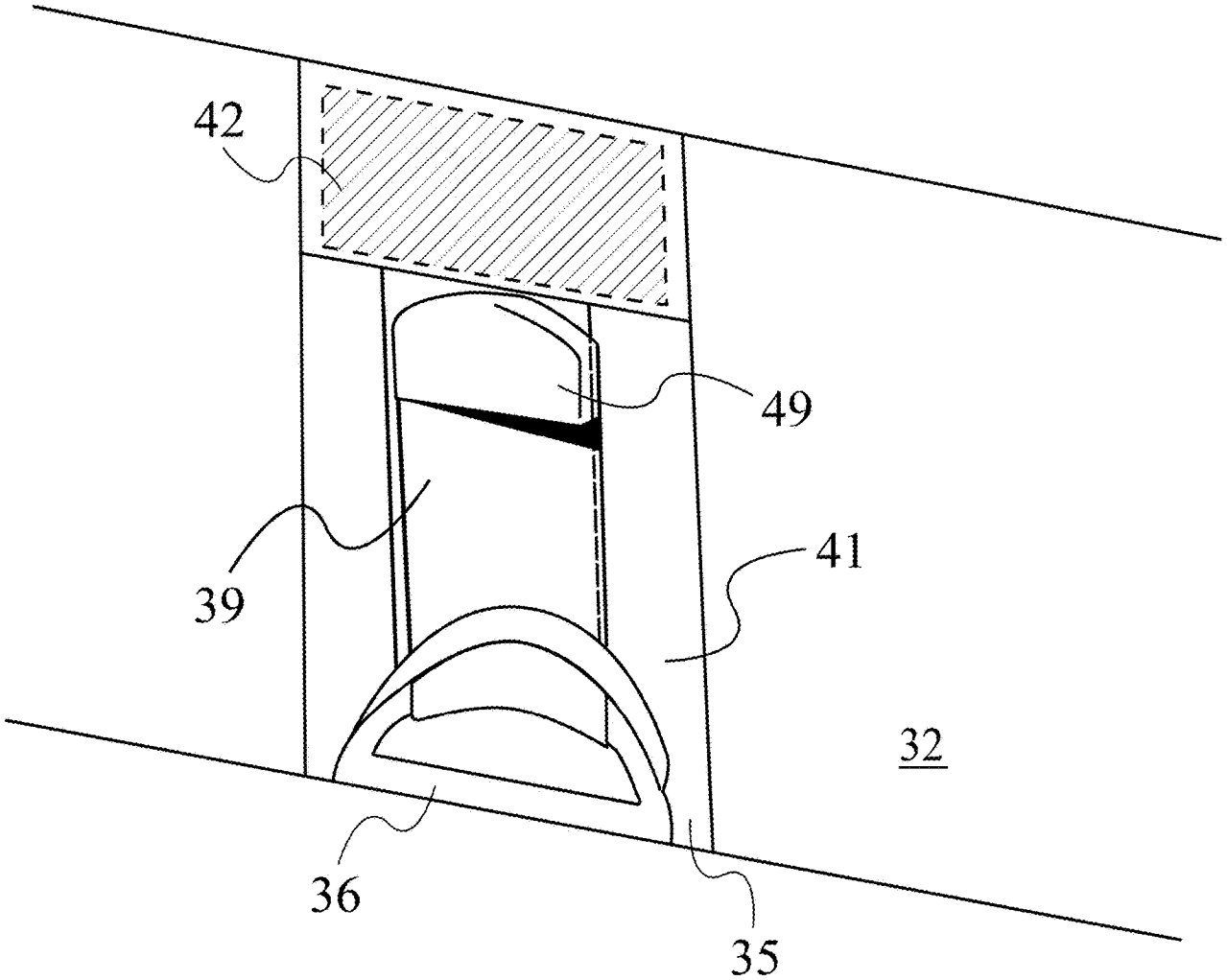
FIG. 9 is a perspective view of a single attachment ring anchor of the anchor assembly of the present invention.

As can be seen in FIG. 7 and FIG. 9, the plurality of anchors 34 of the anchor assembly 30 comprises a single attachment ring anchor 41. More specifically, the single attachment ring anchor 41 comprises an anchor base 35, an anchor ring 36, an anchor strap 39, an anchor fastener 42, and an adjustment tab 49. The anchor fastener 42 is distally mounted on one end of the anchor base 35. The anchor ring 36 is distally mounted on the anchor base 35 opposite the anchor fastener 42. The adjustment tab 49 is distally positioned on one end of the anchor strap 39. The anchor strap 39 is attached to the anchor base 35 at a distal end opposite the adjustment tab 49 and is mounted to the anchor base 35 adjacent to the anchor fastener 42. Additionally, the anchor strap 39 is configured to traverse through and be wrapped around the anchor ring 36 to facilitate adjustment of tightness of the single attachment ring anchor 41 through the adjustment tab 49 of the anchor strap 39.

Figure 8:
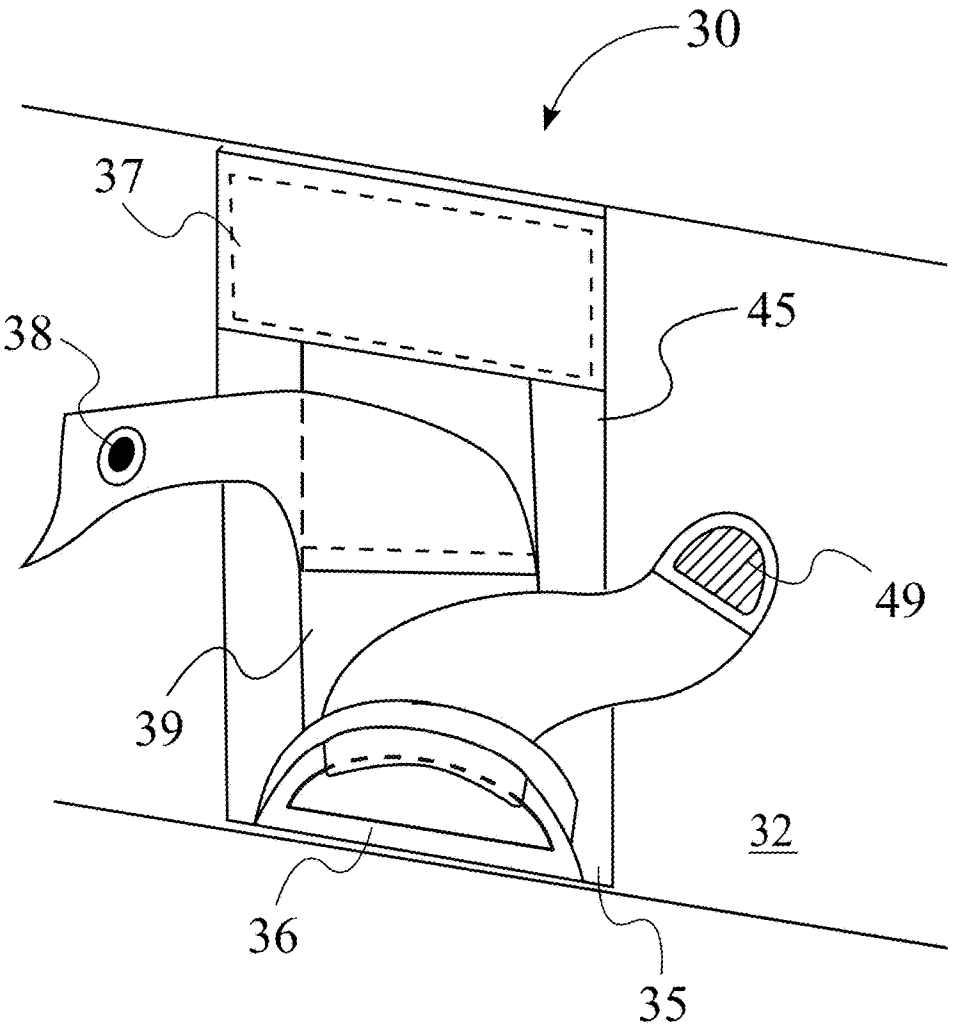
FIG. 8 is a perspective view of a dual attachment ring anchor of the anchor assembly of the present invention.

As can be seen in FIG. 7 and FIG. 8, the plurality of anchors 34 of the anchor assembly 30 comprises a dual attachment ring anchor 45. More specifically, the dual attachment ring anchor 45 comprises an anchor base 35, an anchor ring 36, an anchor strap 39, a fitted sheet fastener 37, a comforter fastener 38 and an adjustment tab 49. The fitted sheet fastener 37 is distally mounted on one end of the anchor base 35. The anchor ring 36 is distally mounted on the anchor base 35 opposite the fitted sheet fastener 37. The adjustment tab 49 is distally positioned on one end of the anchor strap 39. The comfort fastener 38 is mounted to the other end of the anchor strap 39 opposite the adjustment tab 49. The anchor strap 39 is attached to the anchor base 35 adjacent to the center of the anchor strap 39 and is mounted to the anchor base 35 between the anchor ring 36 and the fitted sheet fastener 37. Additionally, the anchor strap 39 is configured to traverse through and be wrapped around the anchor ring 36 to facilitate adjustment of tightness of the dual attachment ring anchor 45 through the adjustment tab 49 of the anchor strap 36.

Figure 10:
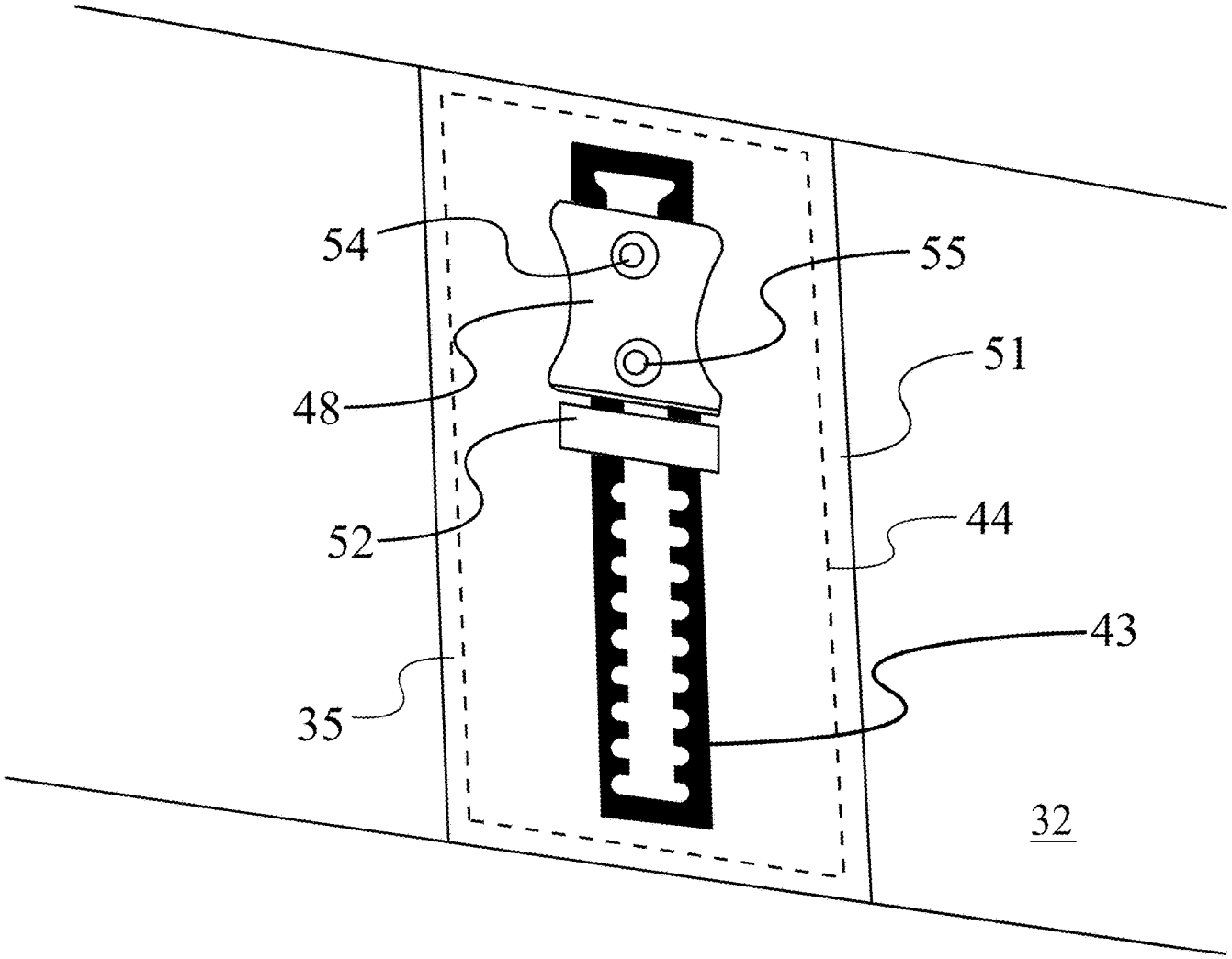
FIG. 10 is a perspective view of a lock-in ring anchor of the anchor assembly of the present invention.
Figure 11:
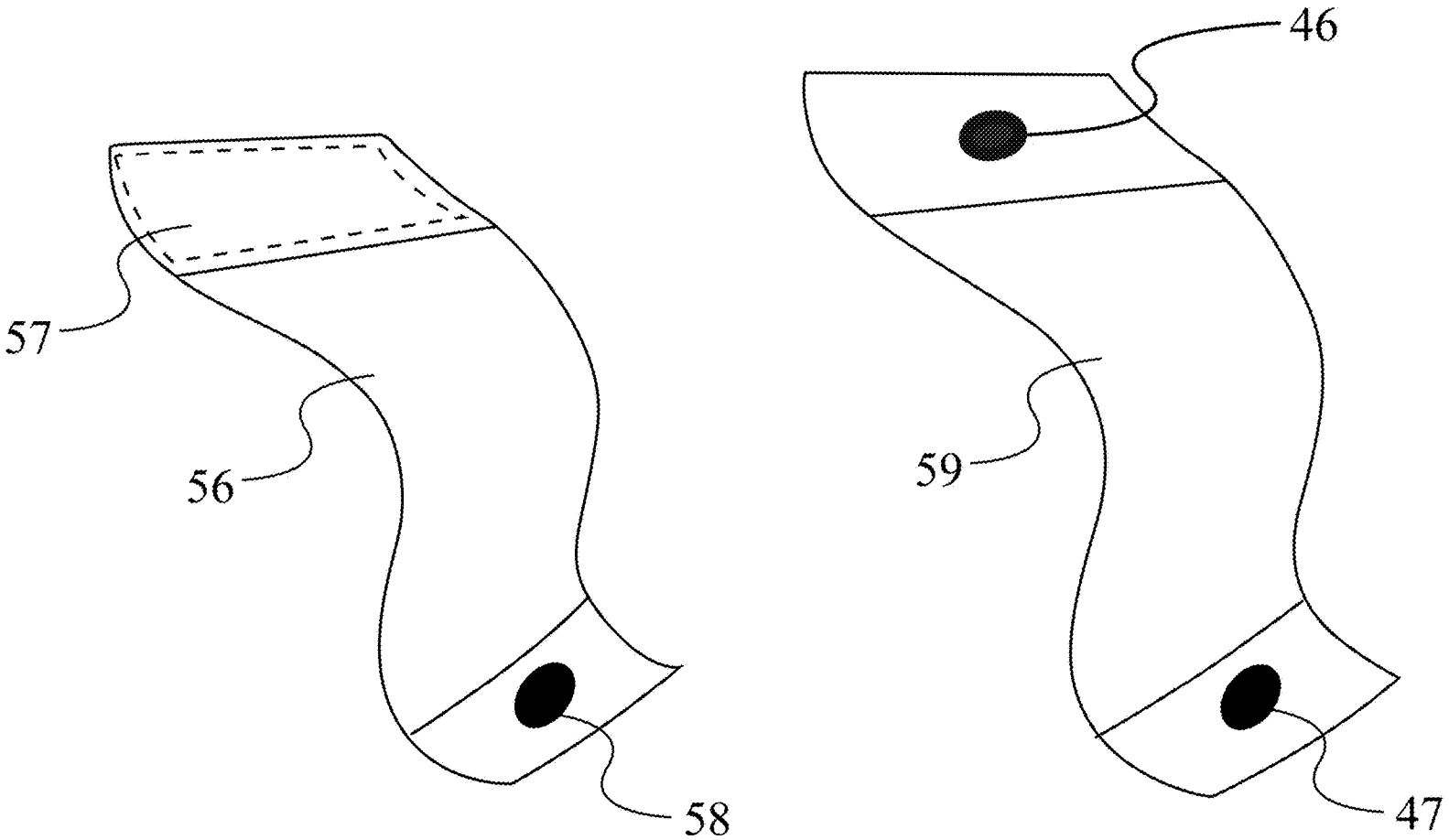
FIG. 11 is a perspective view of a fitted sheet strap and a comforter strap of the lock-in anchor of the anchor assembly of the present invention.

As can be seen in FIG. 7 and FIG. 10 to FIG. 11, the plurality of anchors 34 of the anchor assembly 30 comprises a lock-in anchor 51. More specifically, the lock-in anchor 51 comprises an anchor base 35, a locking mechanism 52, a slider 48, a slotted channel 43, fitted sheet strap 56, and a comforter strap 59. The slotted channel 43 is mounted on the anchor base 35. The locking mechanism 52 is movably attached to the slotted channel 43. The slider 48 is slidably attached to the slotted channel 43 adjacent the locking mechanism 52. Additionally, the slider comprises a fitted sheet strap fastener 54 and a comforter strap fastener 55. The fitted sheet strap 56 comprises a fitted sheet fastener 57. The comforter strap 59 comprises a comforter fastener 46. Both the fitted sheet strap 56 and the comforter strap 59 are attached to the slider 48. The locking mechanism 52 and slider 48 along the slotted channel 43 are configured to facilitate adjustment of tightness of the lock-in anchor 51, wherein releasing the locking mechanism 52 facilitates the slider 48 and the locking mechanism 52 to slide along the slotted channel 43, while activating the locking mechanism 52 locks the locking mechanism 52 and the slider 48 in the slotted channel 43. As can be seen in FIG. 11, the fitted sheet strap 56 of the lock-in anchor 51 comprises a fitted sheet strap anchor fastener 58. More specifically, the fitted sheet strap anchor fastener 58 is mounted on the fitted sheet strap 56 at one distal end. The fitted sheet fastener 57 is mounted on the fitted sheet strap 56 at the other end of the fitted sheet strap 56 opposite the fitted sheet strap anchor fastener 58. Additionally, the fitted sheet strap 56 is attached to the slider 48 through connecting the fitted sheet strap anchor fastener 58 of the fitted sheet strap 56 to the fitted sheet strap fastener 54 of the slider 48. The fitted sheet fastener 57 on the fitted sheet strap 56 may be connected with one of the plurality of edge fasteners 83 of the fitted sheet 80 when a fitted sheet 80 is placed on the mattress 90. Further, the comforter strap 59 comprises a comforter strap anchor fastener 47. The comforter strap anchor fastener 47 is mounted on the comforter strap 59 at one distal end. The comforter fastener 46 is mounted on the comforter strap 59 at the other end of the comforter strap 59 opposite the comforter strap anchor fastener 47. Additionally, the comforter strap 59 is attached to the slider 48 by connecting the comforter strap anchor fastener 47 of the comforter strap 59 to the comforter strap fastener 55 of the slider 48. The comforter fastener 46 may be connected with one of the plurality of anchor fasteners 22 of the comforter 10 to keep the comforter 10 staying tucked on the bed at all times. Further, the tightness of the fitted sheet 80 and the comforter 10, when connected to the lock-in anchor 51 of the anchor assembly 30, may be conveniently adjusted through the slider 48 and the locking mechanism 52 as described above.

As can be seen in FIG. 12 to FIG. 16, the plurality of anchors 34 of the anchor assembly 30 further comprises a channel anchor 61. More specifically, the channel anchor 61 comprises an anchor base 35, a channel body 62, a plurality of raised channels 63, an aperture 64, a plurality of braces 65, a first channel strap 71, and a second channel strap 77. The channel body 62 is mounted to the anchor base 35. The aperture 64 is positioned on the channel body 62. The plurality of raised channels 63 is terminally positioned on the perimeter of the aperture 62. Each end of each of the plurality of braces 65 is positioned inside one of the plurality of raised channels 63, and the plurality of braces 65 is configured to slide in the plurality of raised channels 63 longitudinally along the aperture 64. The first channel strap 71 is configured to be wrapped around one of the plurality of braces 65 adjacent to the center of the first channel strap 71. Additionally, the first channel strap 71 is positioned on the aperture 64 between a longitudinal end and a center of the aperture 64. The first channel strap 71 comprises a first fastener 74 and a second fastener 76. The first fastener 74 is mounted to one distal end of the first channel strap 71, and the second fastener 76 is mounted to the other distal end of the first channel strap 71 opposite the first fastener 74. The second channel strap 77 comprises an adjustment tab 49 and an anchor end 78. The adjustment tab 49 is positioned on a distal end of the second channel strap 77. The anchor end 78 is positioned on the other distal end of the second channel strap 77 opposite the adjustment tab 49. The anchor end 78 of the second channel strap 77 is attached to the anchor base 35 adjacent a longitudinal end of the aperture 64 opposite the first channel strap 71. The second channel strap 77 is positioned on the aperture 64 between the center of the aperture 64 and the longitudinal end of the aperture 64 opposite the first channel strap 71. Further, the second channel strap 77 is configured to be wrapped around one of the plurality of braces 65 adjacent a center of the second channel strap 77 to facilitate adjustment of tightness of the channel anchor 61 through the adjustment tab 49 of the second channel strap 77.

Figure 12:
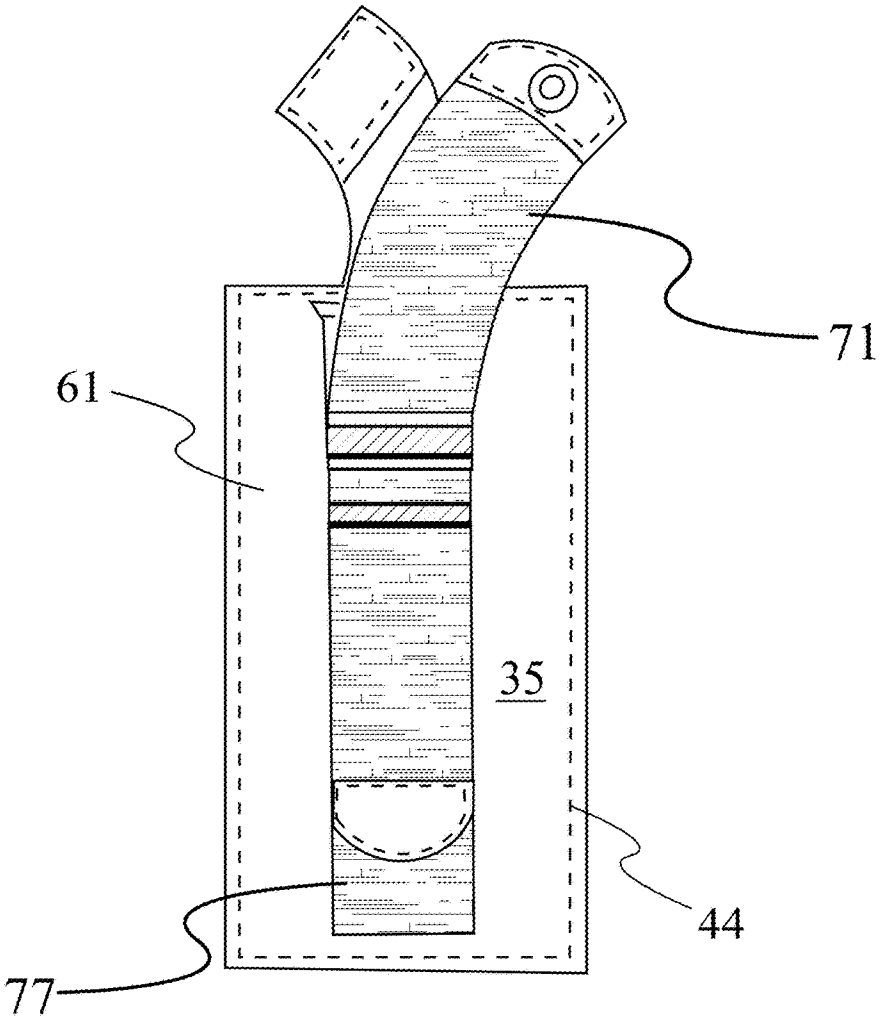
FIG. 12 is a perspective view of a channel anchor of the anchor assembly of the present invention.
Figure 13:
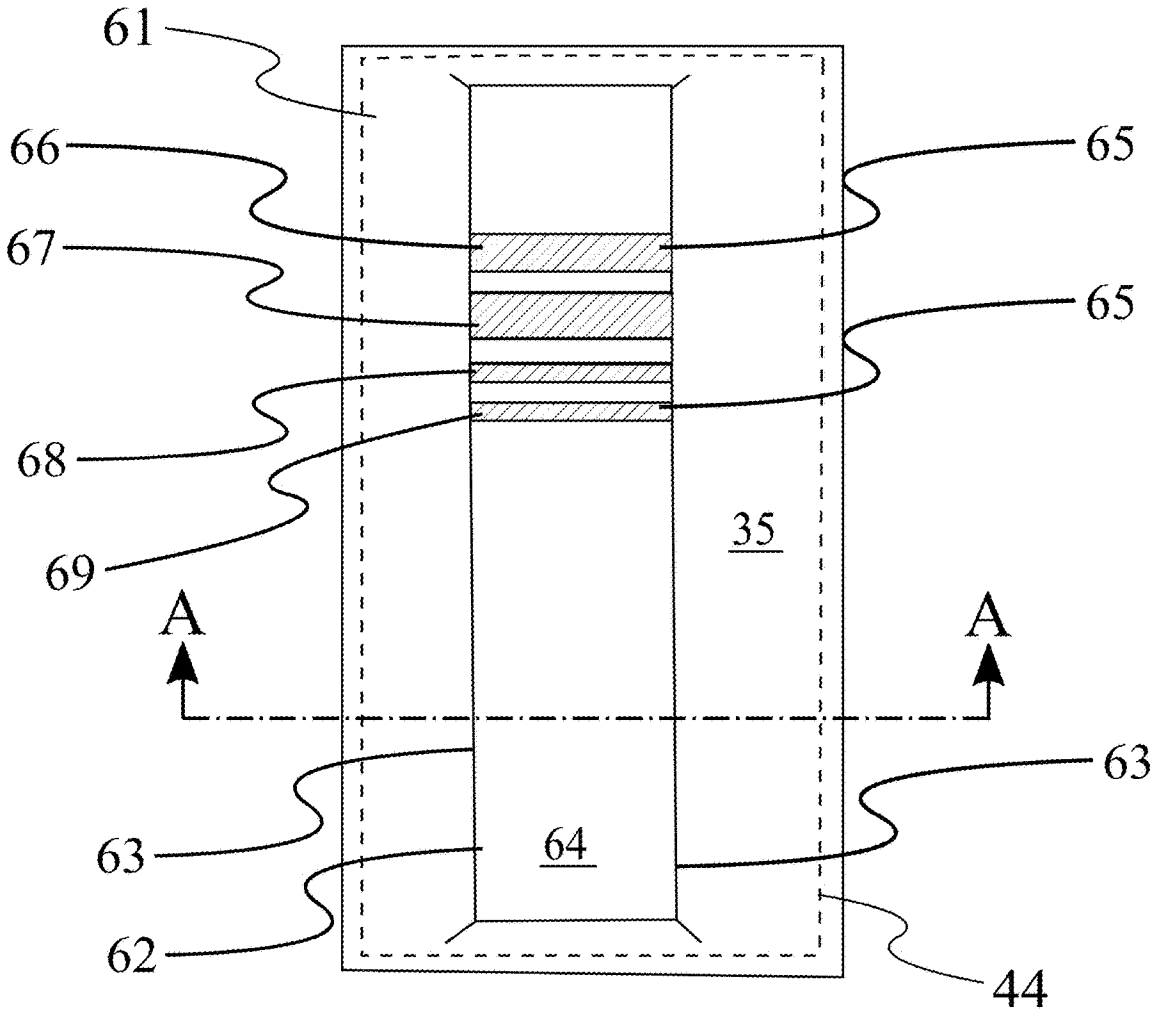
FIG. 13 is a top view of a raised channel and a plurality of braces of the channel anchor of the anchor assembly of the present invention indicating the direction of section cut A.
Figure 14:
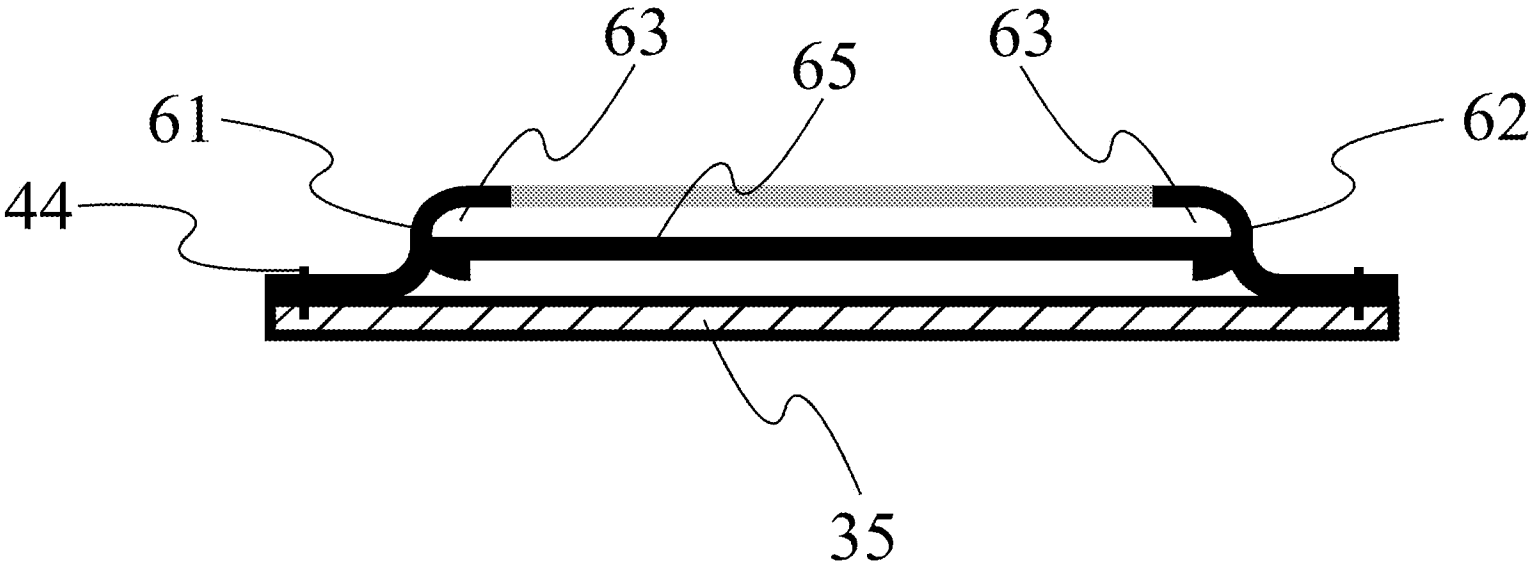
FIG. 14 is a front view of the raised channel the channel anchor of the anchor assembly of the present invention taken along line A-A in FIG. 13.
Figure 15:
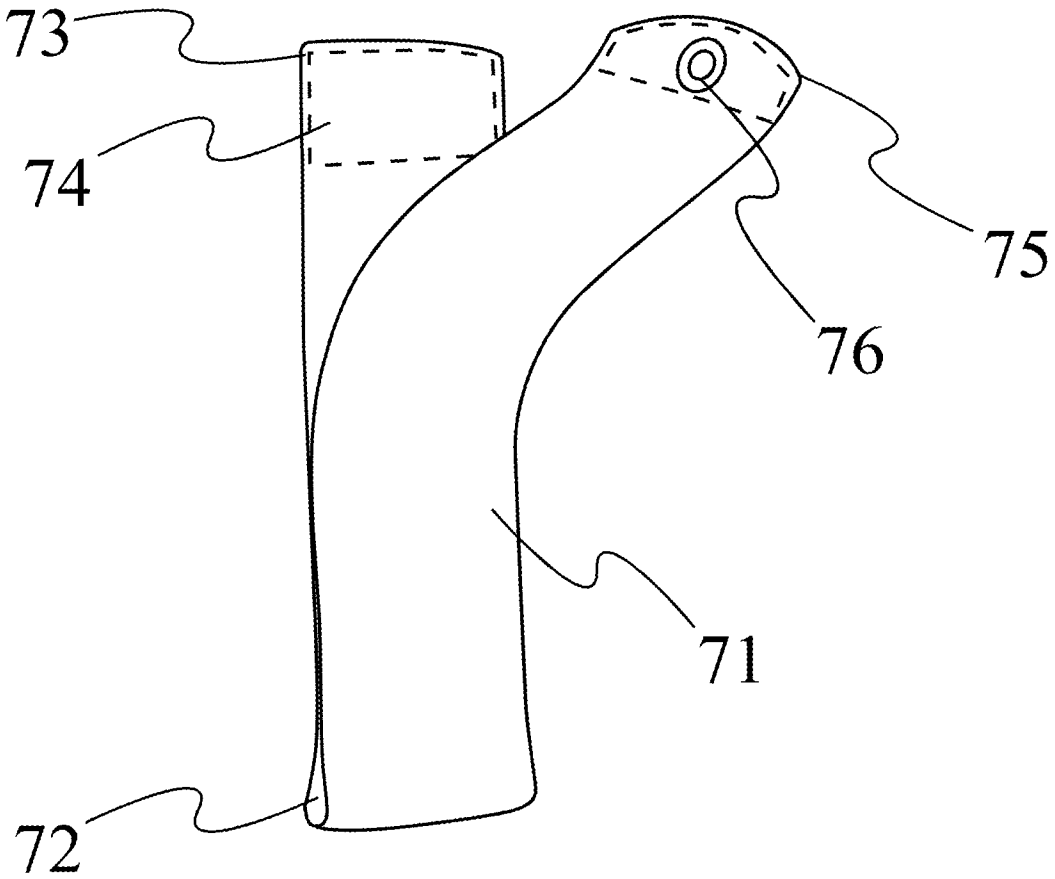
FIG. 15 is a perspective view of a first channel strap of the channel anchor of the present invention.
Figure 16:
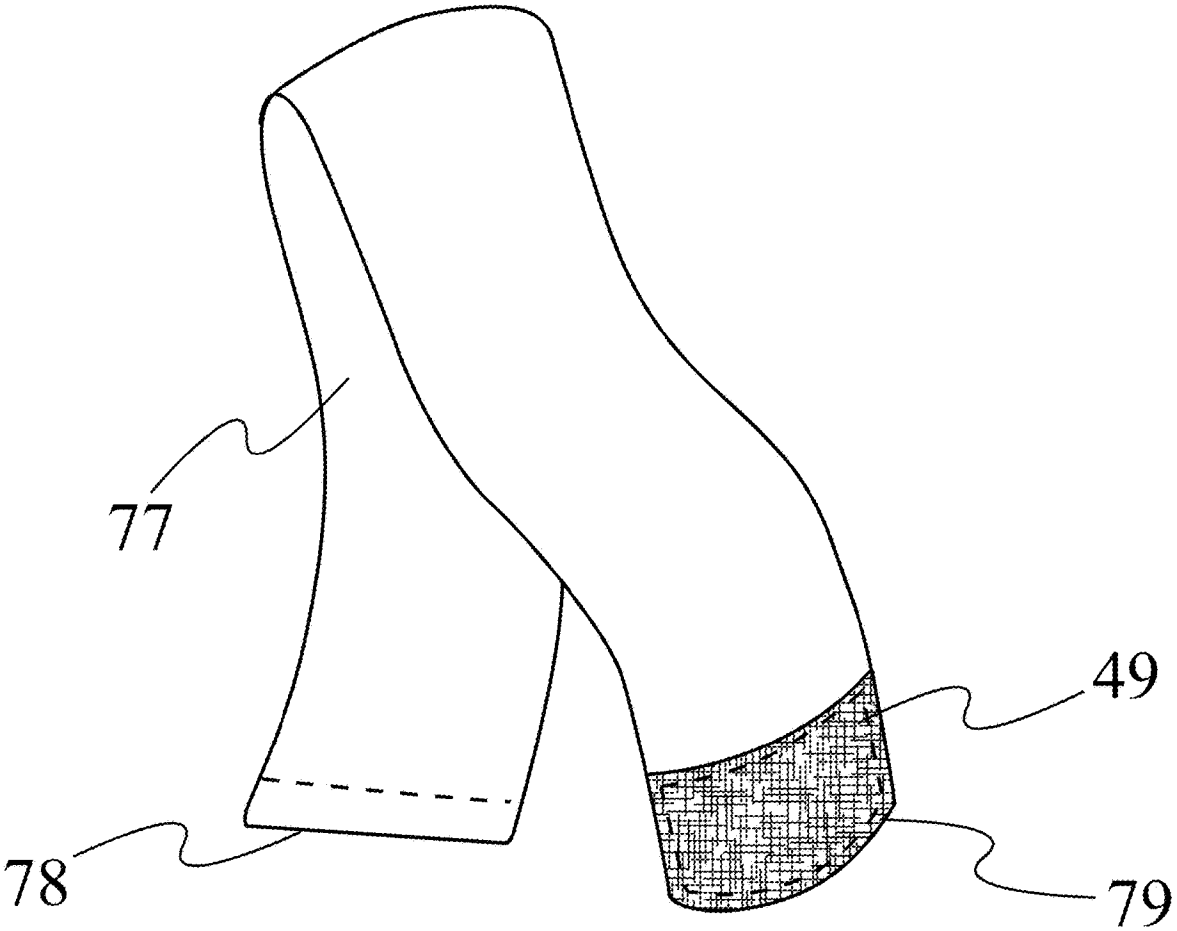
FIG. 16 is a perspective view of a second channel strap of the channel anchor of the present invention.

As can be seen in FIG. 12 to FIG. 16, the plurality of braces 65 of the channel anchor 61 comprises a first outer brace 66, a first inner brace 67, a second outer brace 69, and a second inner brace 68. More specifically, the first outer brace 66 is distally positioned on the aperture. The first inner brace 67 is positioned on the aperture 64 adjacent the first outer brace 66. The second outer brace 69 is positioned on the aperture 64 opposite the first outer brace 66, and the second inner brace 68 is positioned on the aperture 64 adjacent the second outer brace 69. Additionally, the first channel strap 71 comprises a brace pocket 72, a fitted sheet end 73, and a comforter end 75. Specifically, as can be seen in FIG. 15, the brace pocket 72 is positioned on the first channel strap 71 adjacent the center thereof and is configured to be wrapped around the first inner brace 67, as can be seen in FIG. 12. The fitted sheet end 73 is terminally positioned on one distal end of the first channel strap 71 and the comforter end 75 is terminally positioned on the first channel strap 71 opposite the fitted sheet end 73. Additionally, the first fastener 74 is distally mounted to the first channel strap 71 adjacent the fitted sheet end 73 while the second fastener 76 is distally mounted to the first channel strap 71 adjacent the comforter end 75. The first fastener 74 and the second fastener 76 are configured to connect to the fitted sheet 80 and the comforter 10, respectively. Thus, the first channel strap 71 is configured to be wrapped around the first inner brace 67, and the second channel strap 77 is configured to be wrapped around the second inner brace 68. Further, the second channel strap 77 comprises a tab end 79. The tab end 79 is positioned on the second channel strap 77 opposite the anchor end 78. The adjustment tab 49 is positioned at the tab end 79 and provides a grip area for the user to make tightness adjustment of the channel anchor 61. The second channel strap 77 is attached to the anchor base 35 of the channel anchor 61 and is configured to be wrapped around the second inner brace 68 of the plurality of braces 65. When the user is pulling the second channel strap 77 while gripping and holding the adjustment tab 49 of the second channel strap 77, in order to tighten the comforter 10 or the fitted sheet 80, or both, the plurality of braces 65 is sliding in the plurality of raised channels 63 and longitudinally in the aperture 64 towards the center of the aperture 64. Specifically, the second inner brace 68 and the first inner brace 67 each are sliding towards each other. At the same time, the second outer brace 69 is sliding towards the second inner brace 68, and the first outer brace 66 is sliding towards the first inner brace 67. The comforter 10 or the fitted sheet 80, or both are pulled against the mattress, since the first channel strap 71 is attached to the comforter 10 or the fitted sheet 80, or both, and the first channel strap 71 is configured to be wrapped around the first inner brace, the comforter 10, or the fitted sheet 80, or both. When the user stops pulling the second channel strap 77 once the desired tightness is achieved, both the first channel strap 71 and the second channel strap 77 stop sliding and stay in place per the frictions among each of the plurality of braces 65, the first channel strap 71, and the second channel strap 77. Further, the user can follow the same process to reduce the tightness of the comforter 10 or the fitted sheet 80, or both through loosening the second channel strap 77 while gripping and holding the adjustment tab 49 thereof, thus causing the reversed sliding movement of each of the plurality of braces 65, the first channel strap 71, and the second channel strap 77 to achieve a desired tightness adjustment.

As can be seen in FIG. 1 to FIG. 3, the comforter 10 comprises the plurality of anchor fasteners 22, which is distributed on the bottom 13, the first side 14, and the second side 15 of the comforter 10. The plurality of anchors 34 of the anchor assembly 30 is fastened to the plurality of anchor fasteners 22 of the comforter 10. Additionally, the plurality of anchor fasteners 22 is distributed on the back 17 the comforter 10, thus each of the plurality of anchors 32 of the anchor assembly 30 connected to the comforter 10 is completed concealed by the comforter 10. Further, the flap 11 of the comforter 10 can be raised up to be at any angle between zero and 90 degrees with respect to the front 16 of the comforter 10 to the user's desired appearance.

As can be seen in FIG. 1, the comforter 10 of the bedding system of the present invention further comprises a skirt 25. The skirt 25 is attached to the front 16 of the comforter 10 at the edges of the first side 14, the second side 15, and the bottom 13, wherein the skirt 25 flares out to provide a traditional high bed appearance of the bedding system of the present invention whenever the user desires. The skirt 25 can be of any suitable shape and size. Further, the skirt 25 can be permanently or removably attached to the comforter through the use of any suitable fastening means including, but not limited to, sewing, being made to be an integral part of the comforter 10, hook and loop fastener, button fastener, snap fastener, magnet, etc.

Although the invention has been explained in relation to its preferred embodiment, it is to be understood that many other possible modifications and variations can be made without departing from the spirit and scope of the invention as hereinafter claimed.

What is claimed is:

1. A bedding system for keeping a comforter staying tucked and providing efficient making of a bed comprising:

a comforter;

an anchor assembly;

the comforter comprising a top, a bottom, a first side and a second side;

the comforter being configured for wrapping around a mattress with a back face of the mattress exposed;

the bottom, the first side and the second side of the comforter being configured to be wrapped on the mattress;

the anchor assembly being configured to be wrapped around all four sides and the back face of the mattress;

the anchor assembly comprising a base, an anchor band, at least one band fastener, and a plurality of anchors;

one end of the at least one band fastener being terminally attached to one distal end of the anchor band;

the other end of the at least one band fastener being terminally attached to the opposite end of the anchor band;

the anchor band being terminally and longitudinally attached to the perimeter of the base;

the anchor band and the base being configured to form an open box to fit to the exterior of the mattress with a front face of the mattress exposed;

the plurality of anchors being attached to the anchor band;

the plurality of anchors being removably and adjustably fastened to the comforter;

at least one of the plurality of anchors being fastened to the first side between the center of the first side and the bottom of the comforter;

at least one of the plurality of anchors being fastened to the second side between the center of the second side and the bottom of the comforter;

at least one of the plurality of anchors being fastened to the bottom of the comforter;

the plurality of anchors comprising a lock-in anchor;

the lock-in anchor comprising an anchor base, a locking mechanism, a slider, a slotted channel, a fitted sheet strap, and a comforter strap;

the slotted channel being mounted on the anchor base;

the locking mechanism being movably attached to the slotted channel;

the slider slidably attached to the slotted channel adjacent the locking mechanism, wherein the slider is detachable from the locking mechanism;

the slider comprising a fitted sheet strap fastener and a comforter strap fastener;

the fitted sheet strap comprising a fitted sheet fastener;

the comforter strap comprising a comforter fastener;

both the fitted sheet strap and the comforter strap being attached to the slider;

the locking mechanism and slider along the slotted channel being configured to facilitate adjustment of tightness of the lock-in anchor;

wherein releasing the locking mechanism facilitates the slider and the locking mechanism to slide along the slotted channel; and wherein activating the locking mechanism locks the locking mechanism and the slider in the slotted channel.

2. The bedding system for keeping a comforter staying tucked and providing efficient making of a bed as claimed in claim 1 comprising:

the comforter comprising a flap and a flap crease;

the flap being positioned on the top of the comforter; and the flap being folded to the front of the comforter at the flap crease.

3. The bedding system for keeping a comforter staying tucked and providing efficient making of a bed as claimed in claim 1 comprising:

the comforter comprising a plurality of extenders;

each of the plurality of extenders being attached to the bottom, the first side, and the second side of the comforter;

each of the plurality of extenders comprising an extender crease;

each of the plurality of extenders being attached to the comforter at the extender crease;

and wherein the comforter can fit to various thicknesses of the mattress by folding or unfolding the plurality of extenders.

4. The bedding system for keeping a comforter staying tucked and providing efficient making of a bed as claimed in claim 1 comprising:

a fitted sheet;

the fitted sheet being configured to wrap around the front face and the four sides of the mattress;

the fitted sheet being positioned between the mattress and the comforter; and at least one of the plurality of anchors of the anchor assembly being removably and adjustably fastened to the fitted sheet at each of the four sides of the mattress.

5. The bedding system for keeping a comforter staying tucked and providing efficient making of a bed as claimed in claim 4 comprising:

the plurality of anchors comprising a single attachment ring anchor;

the single attachment ring anchor comprising an anchor base, an anchor ring, an anchor strap, an anchor fastener, and an adjustment tab;

the anchor fastener being distally mounted on one end of the anchor base;

the anchor ring being distally mounted on the anchor base opposite the anchor fastener;

the adjustment tab being distally positioned on one end of the anchor strap;

the anchor strap being attached to the anchor base at a distal end opposite the adjustment tab;

the anchor strap being mounted to the anchor base adjacent to the anchor fastener; and the anchor strap being configured to traverse through and be wrapped around the anchor ring to facilitate adjustment of tightness of the single attachment ring anchor through the adjustment tab of the anchor strap.

6. The bedding system for keeping a comforter staying tucked and providing efficient making of a bed as claimed in claim 4 comprising:

the plurality of anchors comprising a dual attachment ring anchor;

the dual attachment ring anchor comprising an anchor base, an anchor ring, an anchor strap, a fitted sheet fastener, a comforter fastener, and an adjustment tab;

the fitted sheet fastener being distally mounted on one end of the anchor base;

the anchor ring being distally mounted on the anchor base opposite the fitted sheet fastener;

the adjustment tab being distally positioned on one end of the anchor strap;

the comfort fastener being mounted to the other end of the anchor strap opposite the adjustment tab;

the anchor strap being attached to the anchor base adjacent to the center of the anchor strap;

the anchor strap being mounted to the anchor base between the anchor ring and the fitted sheet fastener; and the anchor strap being configured to traverse through and be wrapped around the anchor ring to facilitate adjustment of tightness of the dual attachment ring anchor through the adjustment tab of the anchor strap.

7. The bedding system for keeping a comforter staying tucked and providing efficient making of a bed as claimed in claim 4 comprising:

the fitted sheet strap comprising a fitted sheet strap anchor fastener;

the fitted sheet strap anchor fastener being mounted on the fitted sheet strap at one distal end;

the fitted sheet fastener being mounted on the fitted sheet strap at the other end of the fitted sheet strap opposite the fitted sheet strap anchor fastener;

the fitted sheet strap being attached to the slider through connecting the fitted sheet strap anchor fastener of the fitted sheet strap to the fitted sheet strap fastener of the slider;

the comforter strap comprising a comforter strap anchor fastener;

the comforter strap anchor fastener being mounted on the comforter strap at one distal end;

the comforter fastener being mounted on the comforter strap at the other end of the comforter strap opposite the comforter strap anchor fastener; and the comforter strap being attached to the slider by connecting the comforter strap anchor fastener of the comforter strap to the comforter strap fastener of the slider.

8. The bedding system for keeping a comforter staying tucked and providing efficient making of a bed as claimed in claim 4 comprising:

the plurality of anchors comprising a channel anchor;

the channel anchor comprising an anchor base, a channel body, a plurality of raised channels, an aperture, a plurality of braces, a first channel strap, and a second channel strap;

the channel body being mounted to the anchor base;

the aperture being positioned on the channel body;

the plurality of raised channels being terminally positioned on the perimeter of the aperture;

each end of each of the plurality of braces being positioned inside one of the plurality of raised channels;

the plurality of braces being configured to slide in the plurality of raised channels longitudinally along the aperture;

the first channel strap being configured to be wrapped around one of the plurality of braces adjacent to the center of the first channel strap;

the first channel strap being positioned on the aperture between a longitudinal end and a center of the aperture;

the first channel strap comprising a first fastener and a second fastener;

the first fastener being mounted to one distal end of the first channel strap;

the second fastener being mounted to the other distal end of the first channel strap opposite the first fastener;

the second channel strap comprising an adjustment tab and an anchor end;

the adjustment tab being positioned on a distal end of the second channel strap;

the anchor end being positioned on the other distal end of the second channel strap opposite the adjustment tab;

the anchor end of the second channel strap being attached to the anchor base adjacent a longitudinal end of the aperture opposite the first channel strap;

the second channel strap being positioned on the aperture between the center of the aperture and the longitudinal end of the aperture opposite the first channel strap; and the second channel strap being configured to be wrapped around one of the plurality of braces adjacent a center of the second channel strap to facilitate adjustment of tightness of the channel anchor through the adjustment tab of the second channel strap.

9. The bedding system for keeping a comforter staying tucked and providing efficient making of a bed as claimed in claim 8, wherein:

the plurality of braces comprising a first outer brace, a first inner brace, a second outer brace, and a second inner brace;

the first outer brace being distally positioned on the aperture;

the first inner brace being positioned on the aperture adjacent the first outer brace;

the second outer brace being positioned on the aperture opposite the first outer brace;

the second inner brace being positioned on the aperture adjacent the second outer brace;

the first channel strap being configured to be wrapped around the first inner brace; and the second channel strap being configured to be wrapped around the second inner brace.

10. The bedding system for keeping a comforter staying tucked and providing efficient making of a bed as claimed in claim 1 comprising:

the comforter comprising a plurality of anchor fasteners;

the plurality of anchor fasteners being distributed on the bottom, the first side, and the second side of the comforter; and snap fasteners of each of the plurality of elastic straps of the anchor being fastened to each of the plurality of anchor fasteners of the comforter.

11. The bedding system for keeping a comforter staying tucked and providing efficient making of a bed as claimed in claim 1 comprising:

the comforter comprising a skirt;

the skirt being attached to the front at the edges of the first side, the second side, and the bottom of the comforter; and wherein the skirt flares out to provide a traditional high bed appearance of the bedding system.

12. A bedding system for keeping a comforter staying tucked and providing efficient making of a bed comprising:

a comforter;

an anchor assembly;

a fitted sheet;

the comforter comprising a top, a bottom, a first side and a second side;

the comforter being configured for wrapping around a mattress with a back face of the mattress exposed;

the bottom, the first side and the second side of the comforter being configured to be wrapped on the mattress;

the fitted sheet being configured to wrap around the front face and the four sides of the mattress;

the fitted sheet being positioned between the mattress and the comforter;

at least one of the plurality of anchors of the anchor assembly being removably and adjustably fastened to the fitted sheet at each of the four sides of the mattress;

the anchor assembly being configured to be wrapped around all four sides and the back face of the mattress;

the anchor assembly comprising a base, an anchor band, at least one band fastener, and a plurality of anchors;

one end of the at least one band fastener being terminally attached to one distal end of the anchor band;

the other end of the at least one band fastener being terminally attached to the opposite end of the anchor band;

the anchor band being terminally and longitudinally attached to the perimeter of the base;

the anchor band and the base being configured to form an open box to fit to the exterior of the mattress with a front face of the mattress exposed;

the plurality of anchors being attached to the anchor band;

the plurality of anchors being removably and adjustably fastened to the comforter;

at least one of the plurality of anchors being fastened to the first side between the center of the first side and the bottom of the comforter;

at least one of the plurality of anchors being fastened to the second side between the center of the second side and the bottom of the comforter;

at least one of the plurality of anchors being fastened to the bottom of the comforter;

the plurality of anchors comprising a lock-in anchor;

the lock-in anchor comprising an anchor base, a locking mechanism, a slider, a slotted channel, a fitted sheet strap, and a comforter strap;

the slotted channel being mounted on the anchor base;

the locking mechanism being movably attached to the slotted channel;

the slider moving slidably attached to the slotted channel adjacent the locking mechanism, wherein the slider is detachable from the locking mechanism;

the slider comprising a fitted sheet strap fastener and a comforter strap fastener:

the fitted sheet strap comprising a fitted sheet fastener;

the comforter strap comprising a comforter fastener;

both the fitted sheet strap and the comforter strap being attached to the slider;

the fitted sheet strap comprising a fitted sheet strap anchor fastener;

the fitted sheet strap anchor fastener being mounted on the fitted sheet strap at one distal end;

the fitted sheet fastener being mounted on the fitted sheet strap at the other end of the fitted sheet strap opposite the fitted sheet strap anchor fastener;

the fitted sheet strap being attached to the slider through connecting the fitted sheet strap anchor fastener of the fitted sheet strap to the fitted sheet strap fastener of the slider;

the comforter strap comprising a comforter strap anchor fastener;

the comforter strap anchor fastener being mounted on the comforter strap at one distal end;

the comforter fastener being mounted on the comforter strap at the other end of the comforter strap opposite the comforter strap anchor fastener;

the comforter strap being attached to the slider by connecting the comforter strap anchor fastener of the comforter strap to the comforter strap fastener of the slider;

the locking mechanism and slider along the slotted channel being configured to facilitate adjustment of tightness of the lock-in anchor;

wherein releasing the locking mechanism facilitates slider and the locking mechanism slides along the slotted channel; and wherein activating the locking mechanism locks the locking mechanism and the slider in the slotted channel.

13. The bedding system for keeping a comforter staying tucked and providing efficient making of a bed as claimed in claim 12 comprising:

the comforter comprising a flap and a flap crease;

the flap being positioned on the top of the comforter; and the flap being folded to the front of the comforter at the flap crease.

14. The bedding system for keeping a comforter staying tucked and providing efficient making of a bed as claimed in claim 12 comprising:

the comforter comprising a plurality of extenders;

each of the plurality of extenders being attached to the bottom, the first side, and the second side of the comforter;

each of the plurality of extenders comprising an extender crease;

each of the plurality of extenders being attached to the comforter at the extender crease;

and wherein the comforter can fit to various thicknesses of the mattress by folding or unfolding the plurality of extenders.

15. The bedding system for keeping a comforter staying tucked and providing efficient making of a bed as claimed in claim 12 comprising:

the plurality of anchors comprising a single attachment ring anchor;

the single attachment ring anchor comprising an anchor base, an anchor ring, an anchor strap, an anchor fastener, and an adjustment tab;

the anchor fastener being distally mounted on one end of the anchor base;

the anchor ring being distally mounted on the anchor base opposite the anchor fastener;

the adjustment tab being distally positioned on one end of the anchor strap;

the anchor strap being attached to the anchor base at a distal end opposite the adjustment tab;

the anchor strap being mounted to the anchor base adjacent to the anchor fastener; and the anchor strap being configured to traverse through and be wrapped around the anchor ring to facilitate adjustment of tightness of the single attachment ring anchor through the adjustment tab of the anchor strap.

16. The bedding system for keeping a comforter staying tucked and providing efficient making of a bed as claimed in claim 12 comprising:

the plurality of anchors comprising a dual attachment ring anchor;

the dual attachment ring anchor comprising an anchor base, an anchor ring, an anchor strap, a fitted sheet fastener, a comforter fastener, and an adjustment tab;

the fitted sheet fastener being distally mounted on one end of the anchor base;

the anchor ring being distally mounted on the anchor base opposite the fitted sheet fastener;

the adjustment tab being distally positioned on one end of the anchor strap;

the comfort fastener being mounted to the other end of the anchor strap opposite the adjustment tab;

the anchor strap being attached to the anchor base adjacent to the center of the anchor strap;

the anchor strap being mounted to the anchor base between the anchor ring and the fitted sheet fastener; and the anchor strap being configured to traverse through and be wrapped around the anchor ring to facilitate adjustment of tightness of the dual attachment ring anchor through the adjustment tab of the anchor strap.

17. The bedding system for keeping a comforter staying tucked and providing efficient making of a bed as claimed in claim 12 comprising:

the plurality of anchors comprising a channel anchor;

the channel anchor comprising an anchor base, a channel body, a plurality of raised channels, an aperture, a plurality of braces, a first channel strap, and a second channel strap;

the channel body being mounted to the anchor base;

the aperture being positioned on the channel body;

the plurality of raised channels being terminally positioned on the perimeter of the aperture;

each end of each of the plurality of braces being positioned in one of the plurality of raised channels;

the plurality of braces being configured to slide in the plurality of raised channels longitudinally along the aperture;

the first channel strap being configured to be wrapped around one of the plurality of braces adjacent to the center of the first channel strap;

the first channel strap being positioned on the aperture between a longitudinal end and a center of the aperture;

the first channel strap comprising a first fastener and a second fastener;

the first fastener being mounted to one distal end of the first channel strap;

the second fastener being mounted to the other distal end of the first channel strap opposite the first fastener;

the second channel strap comprising an adjustment tab and an anchor end;

the adjustment tab being positioned on a distal end of the second channel strap;

the anchor end being positioned on the other distal end of the second channel strap opposite the adjustment tab;

the anchor end of the second channel strap being attached to the anchor base adjacent a longitudinal end of the aperture opposite the first channel strap;

the second channel strap being positioned on the aperture between the center of the aperture and the longitudinal end of the aperture opposite the first channel strap; and the second channel strap being configured to be wrapped around one of the plurality of braces adjacent a center of the second channel strap to facilitate adjustment of tightness of the channel anchor through the adjustment tab of the second channel strap.

18. The bedding system for keeping a comforter staying tucked and providing efficient making of a bed as claimed in claim 17, wherein:

the plurality of braces comprising a first outer brace, a first inner brace, a second outer brace, and a second inner brace;

the first outer brace being distally positioned on the aperture;

the first inner brace being positioned on the aperture adjacent the first outer brace;

the second outer brace being positioned on the aperture opposite the first outer brace;

the second inner brace being positioned on the aperture adjacent the second outer brace;

the first channel strap being configured to be wrapped around the first inner brace; and the second channel strap being configured to be wrapped around the second inner brace.

* * * * *